US006420321B1

(12) United States Patent
Akiyama et al.

(10) Patent No.: US 6,420,321 B1
(45) Date of Patent: Jul. 16, 2002

(54) FLUORINE-BASED OIL COMPOSITION FOR ACTUATOR ROLLING BEARINGS

(75) Inventors: Motoharu Akiyama, Nagano-ken; Tatsuya Hashimoto, Tokyo, both of (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 09/655,182

(22) Filed: Sep. 5, 2000

(30) Foreign Application Priority Data

Jan. 24, 2000 (JP) ..... 2000-052506

(51) Int. Cl.[7] ..... C10M 133/16; C10M 133/38

(52) U.S. Cl. ..... 508/259; 508/551; 508/554; 508/582

(58) Field of Search ..... 508/259, 551, 508/554, 582

(56) References Cited

U.S. PATENT DOCUMENTS 2,764,603 A * 9/1956 Ahlbrecht et al.
3,665,041 A * 5/1972 Sianesi et al.
4,174,461 A * 11/1979 Sianesi et al.
5,965,496 A * 10/1999 Yamana et al.
6,099,037 A * 8/2000 Gui et al.

FOREIGN PATENT DOCUMENTS

JP 11-325086 11/1999

OTHER PUBLICATIONS

CA 126:31072 Furuya et al., Preparation of perfluorinated compounds as lubricants for magnetic recording tapes, JP 08259482 A2, 1996.*

CA 124:204022 Tomyoshi et al., Epoxy resin compositions for semiconductor device packaging, JP 07316401 A2, 1995.*

CA 123:145039 Yoshizawa et al., Fluorine–containing compounds, lubricants for magnetic recording material, and manufacture of the recording material, JP 07138359 A2, 1995.*

CA 72:21502 Gilbert et al., Fluorine–containing aromatic compounds for textile treatment, DE 191665, 1969.*

* cited by examiner

*Primary Examiner*—Jerry D. Johnson
(74) *Attorney, Agent, or Firm*—Flynn, Thiel, Boutell & Tanis, P.C.

(57) ABSTRACT

A fluorine-based oil composition for actuator rolling bearings containing (A) a fluorine-based oil and (B) a fluorinated ether diamide compound at a ratio by weight of 80 to 9.1 to 20 to 0.1. This composition is much better in torque, outgas and life than existing oil compositions.

5 Claims, No Drawings

FLUORINE-BASED OIL COMPOSITION FOR ACTUATOR ROLLING BEARINGS

BACKGROUND OF THE INVENTION

1. Field of the Invention

This invention relates to a fluorine-based oil composition of actuator rolling bearings. More particularly, the invention relates to a fluorine-based oil composition for actuator rolling bearings comprising a fluorinated ether diamide group additive.

2. Description of the Prior Art

In bearings for information apparatus, many studies have been recently made in order to develop bearings which are low in torque and outgas and also long in life. The ability of recent computers has been improved because a variety of proposals have been made for high densification and high-speed performance to cope with a drastic increase in memory capacity and read velocity. At present, however, there is still much room for improvement. The fluorine-based oil composition of the invention can be conveniently applied to rolling bearings for actuators.

Conventionally, grease is employed for lubrication. Since grease is solid in nature, not only it is not responsible for low torque, but also the actuator does not follow the reading accuracy required on the market. Although it may occur to use, as an oil, a mineral oil, a synthetic hydrocarbon oil, an ester oil, a glycol oil, a silicone oil or the like, these oils are large in outgassing, high in surface tension and poor in permeability, and thus, cannot stand use. Moreover, hitherto commercially sold perfluoroether oils are excellent in outgas and life characteristics, but with the problem that their lubricity is unsatisfactory to make a high coefficient of friction. Thus, such oils cannot meet recent and high requirements.

SUMMARY OF THE INVENTION

The invention has for its object the development of a fluorine-based oil composition for actuator rolling bearings, which can satisfy the properties required for bearings employed in information devices such as HDD (hard disk drive) and FDD (floppy disk drive) memories, CDD (compact disk drive), MOD (magneto-optical disk drive) and the like of computer systems and can be thus used for a bearing of a low torque, a low outgas and a long life.

It will be noted that the fluorine-based oil composition for actuator rolling bearings according to the invention is considered to have a wide utility and can be particularly used in bearings of the following information apparatuses. That is, the composition has been beneficially applied to bearings for driving actuators for writing and reading information, which are employed in peripheral information devices such as HDD (hard disk drive) and FDD (floppy disk drive) memories, CDD (compact disk drive), MOD (magneto-optical disk drive) and the like of computer systems.

It is therefore an object of the invention to provide a fluorine-based oil composition for actuator rolling bearings, having a low torque, low outgas and long life, that is much better than those of known oil compositions and which can be used for bearings of information devices.

Extensive studies have been made by the inventors on the development of bearings having such favorable characteristics as mentioned above, and as a result, it was found that good results are obtained when a fluorine-based oil composition which is characterized by comprising a fluorinated ether diamide additive of a specific chemical structure and a fluorine-based oil is sealed in a bearing. The invention is accomplished based on the above finding to complete the fluorine-based oil composition for actuator rolling bearings.

In the invention, a fluorinated ether diamide compound having a specific type of structure is used as an additive for a fluorine-based oil wherein there can be obtained a fluorine-based oil composition which has an excellent friction characteristic, improved permeability with a low surface tension and can be applied to a bearing and have a low torque, a low outgas and a long life.

EMBODIMENTS OF THE INVENTION

The composition of the invention, which comprises a fluorine-based oil and an additive of a fluorinated ether diamide compound having a specific type of chemical structure, is novel in its combination. The amount of the fluorinated ether diamide compound additive having a specific type of chemical structure is in the range of 0.1 to 20 wt. % of the entire oil composition. Preferably, the amount ranges from 1 wt. % to 5 wt. %.

If the amount is less than 0.1 wt. %, there is the apprehension that the resultant oil composition becomes so high in surface tension that it cannot permeat throughout a bearing. In contrast, when the additive is added in amounts exceeding 20 wt. %, not only is the lowering of surface tension not observed, but also the oil composition unfavorably becomes high in viscosity.

It will be noted that the fluorinated ether diamide is a known one and a variety of preparation processes may be considered, among which it is preferred to prepare the compound from a compound having a carboxyl group at terminals of a fluorinated ether molecule and a diamine compound.

The fluorine oil should preferably have a molecular weight of about 1,000 to about 10,000. If the molecular weight is lower than 1,000, the oil is liable to evaporate, resulting in a high outgas characteristic. Over 10,000, the viscosity becomes high, thus leading to a high torque.

Further, the fluorine-based oil composition for actuator rolling bearings according to the invention may comprise various types of additives employed in ordinary fluorine-based oil compositions.

More particularly, mention is made, as additives used in ordinary fluorine-based oil compositions, of antioxidants such as phenyl-α(β) -naphthylamine, alkyldiphenylamines, phenothiazine, t-butylphenol and rust preventive compounds such as metal sulfonates, nonionic and amine rust inhibitors, and the like.

Preferred embodiments of the invention are described below.

(1) A fluorine-based oil composition for actuator rolling bearings comprising:

(A) a fluorine-based oil; and (B) an additive of the general formula (i)

$$Z—Y—Z \quad \text{(i)}$$

wherein Z represents a fluorinated ether group of the formula (ii)

$$—(\underset{\underset{CF_3}{|}}{CF}—CF_2—O)_m—CF_2—CF_3 \quad \text{(ii)}$$

in which m is an integer of 1 to 50, and Y represents an aliphatic diamido group of the general formula (iii)

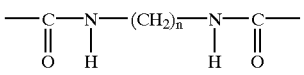

(iii)

in which n is an integer of 1 to 30, or an alicyclic diamido group of the general formula (iv)

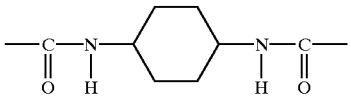

(iv)

or an aromatic diamido group of the general formula (v)

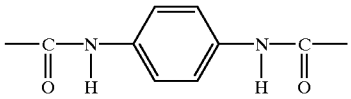

(v)

or a cyclic diamido group of the general formula (vi)

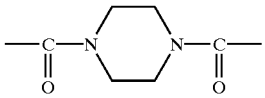

(vi)

(2) A fluorine-based oil composition for actuator rolling bearings comprising:

(A) a fluorine-based oil composed of a fluorinated ether of the general formula (vii)

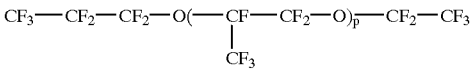

(vii)

wherein p is an integer of 6 to 100; and (B) a fluorinated ether diamide additive of the general formulae (ii) and (iii)

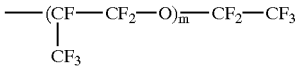

(ii)

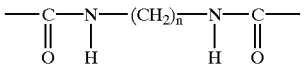

(iii)

(3) A fluorine-based oil composition for actuator rolling bearings comprising:

(A) a fluorine-based oil composed of a fluorinated ether of the general formula (vii)

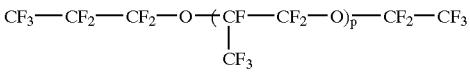

(vii)

wherein p is an integer of 6 to 100; and (B) a fluorinated ether alicyclic diamide additive of the general formulae (ii) and (iv)

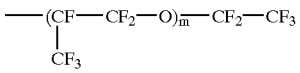

(ii)

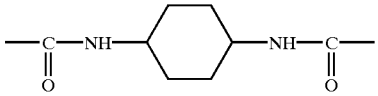

(iv)

(4) A fluorine-based oil composition for actuator rolling bearings comprising:

(A) a fluorine oil composed of a fluorinated ether of the general formula (vii)

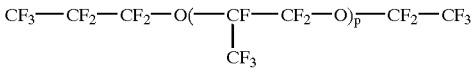

(vii)

wherein p is an integer of 6 to 100; and (B) a fluorinated ether aromatic diamide additive of the general formulae (ii) and (v)

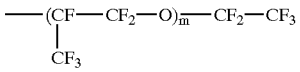

(ii)

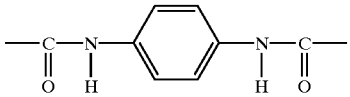

(v)

(5) A fluorine-based oil composition for actuator rolling bearings comprising:

(A) a fluorine oil composed of a fluorinated ether of the general formula (vii)

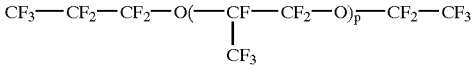

(vii)

wherein p is an integer of 6 to 100; and (B) a fluorinated ether cyclic diamide additive of the general formulae (ii) and (vi)

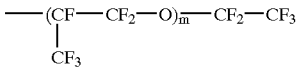

(ii)

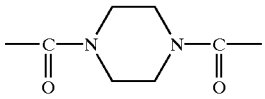

(vi)

(6) A fluorine-based oil composition for actuator rolling bearings as recited in any one of 1 to 5 above, wherein a ratio by weight between the fluorine-based oil (A) and the additive (B) is at 80 to 99.1:20 to 0.1.

(7) A fluorine-based oil composition for actuator rolling bearings as recited in any one of (1) to (6) above, wherein the fluorine-based oil (A) has an average molecular weight of 1,000 to 10,000.

(8) A fluorine-based oil composition for actuator rolling bearings as recited in any one of (1) to (7) above, wherein the oil composition has a viscosity ranging from 5 to 2,000 $mm^2$/second.

(9) A fluorine-based oil composition for actuator rolling bearings as recited in any one of (1) to (8) above, wherein the oil composition further comprises an antioxidant and a rust inhibitor.

(10) A fluorine-based oil composition for actuator rolling bearings as recited in any one of (1) to (9) above, wherein the oil composition is sealed in at a bearing space capacity of 2 to 55 vol %.

The invention is more particularly described by way of example, which should not be construed as limiting the invention thereto.

EXAMPLES

Four types of fluorine-based base oil compositions were obtained while making use of compounds of the general formula (vii) wherein p in the formula was so controlled as to provide different molecular weights, i.e. average molecular weights of (a) 1500 to 2500, (b) 2500 to 3500, (c) 3000 to 4000, and (d) 7000 to 8000.

The characteristics of the compositions are shown in Table 1. For comparison, the characteristics of a polyol ester (e) are also shown.

TABLE 1

| | a | b | c | d | e |
|---|---|---|---|---|---|
| Average molecular weight | 1500 to 2500 | 2500 to 3500 | 3000 to 4000 | 7000 to 8000 | 500 to 700 |
| Kinetic viscosity 40° C. ($mm^2/s$) | 25 | 60 | 95 | 390 | 18 |
| Viscosity index | 85 | 130 | 130 | 140 | 130 |
| Pour point (° C.) | −60 | −55 | −45 | −30 | −40 |
| Density 20° C. (g/l) | 1.88 | 1.89 | 1.89 | 1.90 | 0.9 |
| Evaporation loss 150° C. × 24 hours | 35% | 10% | 2% | 0% | 50% |
| Surface tension 20° C. (dynes/cm) | 21 | 22 | 22 | 23 | 35 |
| Coefficient of friction | 0.16 | 0.15 | 0.16 | 0.15 | 0.17 |

The samples of the examples were, respectively, evaluated according to the following method.

In Examples 1 to 6, a fluorine oil used in the fluorine-based oil compositions for actuator rolling bearings was a fluorinated ether of the general formula (vii)

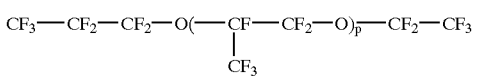

(vii)

As an additive, there was used a fluorinated ether aliphatic diamide additive (F1) represented by the formulae (ii) and (iii)

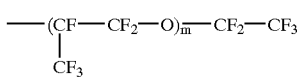

(ii)

wherein m=15 to 25, and

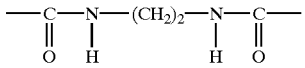

(iii)

a ratio by weight between the fluorine-based oil and the additive of 80 to 99. 1:20 to 0.1 to provide fluorine-based oil composition for bearings of an actuator.

In Examples 7 to 10 of fluorine-based oil compositions for bearings of an actuator, there were obtained the fluorine-based oil compositions for bearings of an actuator in the same manner as in Example 1 except that a fluorinated ether aliphatic diamide (F2) of the general formula (iii) wherein n=6 was used as the additive of the component (B).

In Examples 11 to 14 of fluorine-based oil compositions for bearings of an actuator, there were obtained the fluorine-based oil compositions for bearings of an actuator in the same manner as in Example 1 except that a fluorinated ether aliphatic diamide (F3) of the general formula (iii) wherein n=10 was used as the additive of the component (B).

In Examples 15 to 17 of fluorine-based oil compositions for bearings of an actuator, there were obtained the fluorine-based oil compositions for bearings of an actuator in the same manner as in Example 1 except that a fluorinated ether cyclohexyldiamide (F4) was used as the additive of the component (B).

In Examples 18 to 20 of fluorine-based oil compositions for bearings of an actuator, there were obtained the fluorine-based oil compositions for bearings of an actuator in the same manner as in Example 1 except that a fluorinated ether p-aminoaniline diamide (F5) was used as the additive of the component (B).

In Examples 21 to 23 of fluorine-based oil compositions for bearings of an actuator, there were obtained the fluorine-based oil compositions for bearings of an actuator in the same manner as in Example 1 except that a fluorinated ether piperazinediamide (F6) was used as the additive of the component (B).

The formulation ingredients and ratios are shown in Table 2.

TABLE 2

| Preparatory Example | Base Oil | Additive | Ratio of Additive (mass %) | Coefficient of Friction |
|---|---|---|---|---|
| 1 | a | F1 | 1.0 | 0.13 |
| 2 | b | F1 | 1.0 | 0.13 |
| 3 | b | F1 | 3.0 | 0.12 |
| 4 | b | F1 | 5.0 | 0.12 |
| 5 | c | F1 | 10.0 | 0.12 |
| 6 | d | F1 | 15.0 | 0.11 |
| 7 | a | F2 | 3.0 | 0.12 |
| 8 | b | F2 | 5.0 | 0.12 |
| 9 | c | F2 | 13.0 | 0.12 |
| 10 | b | F2 | 18.0 | 0.13 |
| 11 | b | F3 | 0.5 | 0.13 |
| 12 | a | F3 | 5.0 | 0.12 |
| 13 | b | F3 | 7.0 | 0.12 |
| 14 | d | F3 | 9.0 | 0.13 |
| 15 | b | F4 | 0.5 | 0.13 |
| 16 | c | F4 | 3.0 | 0.12 |
| 17 | a | F4 | 7.0 | 0.12 |
| 18 | c | F5 | 5.0 | 0.12 |
| 19 | a | F5 | 7.0 | 0.12 |
| 20 | d | F5 | 10.0 | 0.12 |
| 21 | a | F6 | 0.1 | 0.13 |
| 22 | c | F6 | 3.0 | 0.12 |
| 23 | b | F6 | 20.0 | 0.13 |
| Comparative | a | nil | Nil | 0.16 |

TABLE 2-continued

| Preparatory Example | Base Oil | Additive | Ratio of Additive (mass %) | Coefficient of Friction |
|---|---|---|---|---|
| Example 1 | | | | |
| Comparative Example 2 | b | nil | Nil | 0.15 |
| Comparative Example 3 | c | nil | Nil | 0.16 |
| Comparative Example 4 | a | F2 | 30.0 | 0.17 |
| Comparative Example 5 | a | Formula (viii) | 2.0 | 0.18 |
| Comparative Example 6 | b | Formula (ix) | 3.0 | 0.16 |
| Comparative Example 7 | b | Formula (x) | 1.0 | Not dissolved |
| Comparative Example 8 | c | Formula (xi) | 7.0 | 0.15 |
| Comparative Example 9 | C | Formula (xi) | 2.0 | 0.15 |
| Comparative Example 10 | e formula(xii) | Nil | Nil | 0.17 |
| Comparative Example 11 | e formula(xii) | F1 | 5.0 | 0.16 |

The coefficient of friction was measured by using Four Balls Tester (SODA TYPE). The Soda-type pendulum friction tester is one wherein a sample oil was placed at the friction portion of a fulcrum of the pendulum, after which the pendulum was vibrated and the coefficient of friction at the fulcrum portion was calculated from the degree of attenuation of the pendulum. The measuring conditions included one vertical thread load of 40 g, two horizontal thread loads, each of which was at 80 g, an initial amplitude of 0.5 radians, and a test temperature of room temperature.

Comparative Examples

For comparison, there were prepared fluorine-based oil composition for actuator rolling bearings in the same manner as in the Examples for the fluorine-based oil compositions except that no additive was used or additives other than those of the invention were used as the additive of component (B). These are shown in Table 2 as Comparative Examples.

In Comparative Examples 1 to 3, there were prepared fluorine-based oil compositions for actuator rolling bearings without use of any additive.

In Comparative Example 4, a fluorine-based oil composition for actuator rolling bearings was prepared using a large amount of F2.

In Comparative Examples 1 to 3, there were prepared fluorine-based oil compositions for actuator rolling bearings without use of any additive.

In Comparative Example 4, a fluorine-based oil composition for actuator rolling bearings was prepared using a large amount of F2.

In Comparative Example 5, there was prepared a fluorine-based oil composition for actuator rolling bearings in the same manner as in the Examples except that an additive of the chemical formula (viii) was used.

(viii)

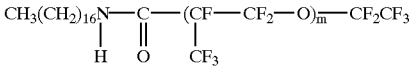

In Comparative Example 6, there was prepared a fluorine-based oil composition for actuator rolling bearings in the same manner as in the Examples except that an additive of the chemical formula (ix) was used.

(ix)

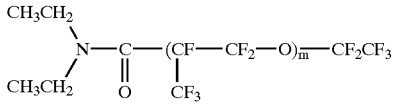

In Comparative Example 7, there was prepared a fluorine-based oil composition for actuator rolling bearings in the same manner as in the Examples except that an additive of the chemical formula (x) was used.

(X)

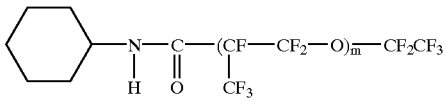

In Comparative Examples 8 and 9, there were prepared fluorine-based oil compositions for actuator rolling bearings in the same manner as in the Examples except that an additive of the chemical formula (xi) was used.

(Xi)

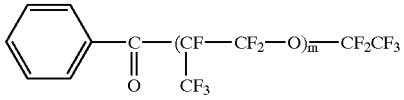

In Comparative Example 10, there was prepared a fluorine-based oil composition for actuator rolling bearings in the same manner as in the Examples except that a base oil represented by the chemical formula (xii) was used, but not using any additive.

(Xii)

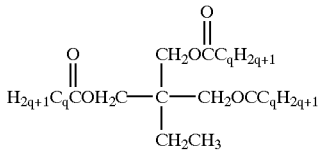

wherein 1 is an integer of 6 to 10.

In Comparative Example 11, a fluorine-based oil composition for actuator rolling bearings was prepared using the polyester (e) as a base oil and F1 as an additive.

The fluorine-based oil composition for actuator rolling bearings prepared in the Examples and Comparative Examples were each sealed in a pivot ass'y bearing, with the results shown in Table 3.

TABLE 3

| Example | Torque of Rotation | Outgas | Overall evaluation |
|---|---|---|---|
| 1 | ○ | ○ | ○ |
| 2 | ◎ | ◎ | ◎ |
| 3 | ◎ | ◎ | ◎ |
| 4 | ◎ | ◎ | ◎ |
| 5 | ◎ | ◎ | ◎ |
| 6 | ◎ | ◎ | ◎ |
| 7 | ○ | ○ | ○ |
| 8 | ◎ | ◎ | ◎ |
| 9 | ◎ | ◎ | ◎ |
| 10 | ◎ | ◎ | ◎ |

TABLE 3-continued

| Example | Torque of Rotation | Outgas | Overall evaluation |
|---|---|---|---|
| 11 | ◎ | ◎ | ◎ |
| 12 | ◎ | ○ | ◎ |
| 13 | ◎ | ◎ | ◎ |
| 14 | ◎ | ◎ | ◎ |
| 16 | ◎ | ◎ | ◎ |
| 17 | ○ | ○ | ○ |
| 18 | ◎ | ◎ | ◎ |
| 19 | ◎ | ○ | ◎ |
| 20 | ◎ | ◎ | ◎ |
| 21 | ○ | ○ | ○ |
| 22 | ◎ | ◎ | ◎ |
| 23 | ◎ | ◎ | ◎ |
| Comparative Example 1 | Δ | ○ | Δ |
| 2 | Δ | ◎ | Δ |
| 3 | Δ | ◎ | Δ |
| 4 | x | ○ | x |
| 5 | x | ○ | x |
| 6 | x | ◎ | x |
| 7 | x | ○ | x |
| 8 | x | ◎ | x |
| 9 | x | ◎ | x |
| 10 | ◎ | x | x |
| 11 | ◎ | x | x |

The bearing characteristic tests were carried out to measure rotational torque and outgas characteristics.

The torque of rotation was measured by use of a torque tester in the state of a fixedly bonded pivot ass'y bearing under a given load pressure at the number of rotations of 2 r.p.m., at room temperature.

The outgas characteristic was measured according to a dynamic head space method using several milligrams of each sample.

A lower torque and a smaller outgas characteristic are better, respectively, and were evaluated according to the following four ranks.

◎: Excellent

○: Good

Δ: Moderate x: Poor

As will be apparent from Table 3, the fluorine-based oil composition for actuator rolling bearings according to the invention can be conveniently employed for various types of actuator rolling bearings.

Thus, it has been confirmed that the fluorine-based oil composition for actuator rolling bearings ensures various characteristics which will not be attained according to existing polyol ester oil compositions, i.e. a much better low torque, a low outgas and a long life.

What is claimed is:

1. A fluorine-based oil composition for actuator rolling bearings comprising:

(A) a fluorine-based oil; and (B) an additive of the general formula (i)

$$Z—Y—Z \quad \text{(i)}$$

wherein Z represents a fluorinated ether group of the formula (ii)

$$—(CF(CF_3)—CF_2—O)_m—CF_2—CF_3 \quad \text{(ii)}$$

in which m is an integer of 1 to 50, and Y represents an aliphatic diamido group of the general formula (iii)

$$—C(=O)—N(H)—(CH_2)_n—N(H)—C(=O)— \quad \text{(iii)}$$

in which n is an integer of 1 to 30, or an alicyclic diamido group of the general formula (iv)

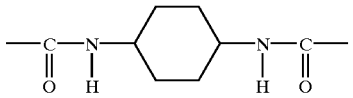

(iv)

or an aromatic diamido group of the general formula (v)

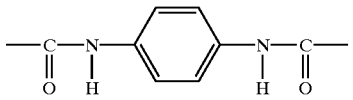

(v)

or a cyclic diamido group of the general formula (vi)

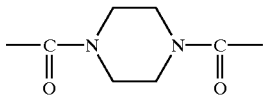

(vi)

wherein the weight ratio of the fluorine-based oil (A) and the additive (B) is from 80 to 99.9:20 to 0.1.

2. A fluorine-based oil composition for actuator rolling bearings comprising:

(A) a fluorine-based oil composed of a fluorinated ether of the general formula (vii)

$$CF_3—CF_2—CF_2—O—(CF(CF_3)—CF_2—O)_p—CF_2—CF_3 \quad \text{(vii)}$$

wherein p is an integer of 6 to 100; and (B) a fluorinated ether aliphatic diamide additive of the general formulae (ii) and (iii)

$$—(CF(CF_3)—CF_2—O)_m—CF_2—CF_3 \quad \text{(ii)}$$

$$—C(=O)—N(H)—(CH_2)_n—N(H)—C(=O)— \quad \text{(iii)}$$

wherein m is an integer of 1 to 50 and n is an integer of 1 to 30; wherein the weight ratio of the fluorine-based oil (A) and the additive (B) is from 80 to 99.9:20 to 0.1.

3. A fluorine-based oil composition for actuator rolling bearings comprising:

(A) a fluorine-based oil composed of a fluorinated ether of the general formula (vii)

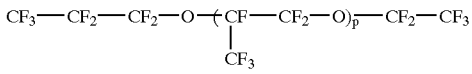

(vii)

wherein p is an integer of 6 to 100; and (B) a fluorinated ether alicyclic diamide additive of the general formulae (ii) and (iv)

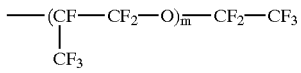

(ii)

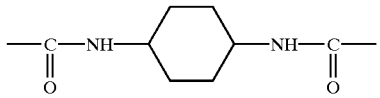

(iv)

wherein m is an integer of 1 to 50; wherein the weight ratio of the fluorine-based oil (A) and the additive (B) is from 80 to 99.9:20 to 0.1.

4. A fluorine-based oil composition for actuator rolling bearings comprising:

(A) a fluorine oil composed of a fluorinated ether of the general formula (vii)

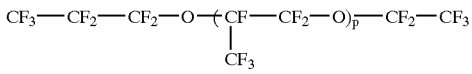

(vii)

wherein p is an integer of 6 to 100; and (B) a fluorinated ether aromatic diamide additive of the general formulae (ii) and (v)

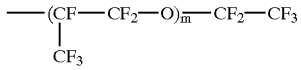

(ii)

-continued

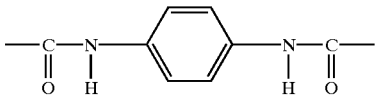

(v)

wherein m is an integer of 1 to 50; wherein the weight ratio of the fluorine-based oil (A) and the additive (B) is from 80 to 99.9:20 to 0.1.

5. A fluorine-based oil composition for actuator rolling bearings comprising:

A) a fluorine oil composed of a fluorinated ether of the general formula (vii)

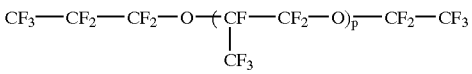

(vii)

wherein p is an integer of 6 to 100; and (B) a fluorinated ether cyclic diamide additive of the general formulae (ii) and (vi)

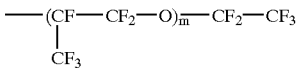

(ii)

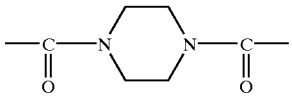

(vi)

wherein m is an integer of 1 to 50; wherein the weight ratio of the fluorine-based oil (A) and the additive (B) is from 80 to 99.9:20 to 0.1.

* * * * *